US012264488B1

(12) United States Patent
Nickerson

(10) Patent No.: US 12,264,488 B1
(45) Date of Patent: Apr. 1, 2025

(54) INTERCHANGEABLE UNDERLAYER FOR A ROOFING DEVICE

(71) Applicants: Michael Joshua Nickerson, Eastern Passage (CA); Wesley James Genaille, Bedford (CA)

(72) Inventor: Michael Joshua Nickerson, Eastern Passage (CA)

(73) Assignees: Michael Joshua Nickerson, Eastern Passage (CA); Wesley Genaille, Bedford (CA)

( * ) Notice: Subject to any disclaimer, the term of this patent is extended or adjusted under 35 U.S.C. 154(b) by 18 days.

(21) Appl. No.: 18/477,961

(22) Filed: Sep. 29, 2023

(51) Int. Cl.
*E04G 3/26* (2006.01)

(52) U.S. Cl.
CPC ..... *E04G 3/265* (2013.01)

(58) Field of Classification Search
CPC ..... E04G 3/265; E04D 15/00
USPC ..... 248/247
See application file for complete search history.

(56) References Cited

U.S. PATENT DOCUMENTS

| | | | | |
|---|---|---|---|---|
| 2,708,543 | A | 5/1955 | John | |
| 7,772,136 | B2 | 8/2010 | Arthurs et al. | |
| 8,438,785 | B2 | 5/2013 | McDonough | |
| 9,834,937 | B2 | 12/2017 | Warner | |
| 10,273,694 | B2 * | 4/2019 | Wright | F16L 3/00 |
| 10,844,616 | B2 * | 11/2020 | Rashid | E04D 15/02 |
| 12,018,500 | B2 * | 6/2024 | Rashid | E04D 15/00 |
| 2010/0227103 | A1 | 9/2010 | Hohmann, Jr. | |
| 2020/0128912 | A1 | 4/2020 | Ford | |
| 2021/0180342 | A1 * | 6/2021 | Rashid | E04G 3/265 |
| 2022/0282502 | A1 * | 9/2022 | Rashid | E04G 3/265 |

FOREIGN PATENT DOCUMENTS

| | | | |
|---|---|---|---|
| DE | 202009016339 | U1 | 3/2010 |
| JP | 2002322779 | A | 11/2002 |
| WO | 2015162436 | A1 | 10/2015 |

OTHER PUBLICATIONS

The Pitch Hopper https://www.thepitchhopper.com/ Dec. 5, 2022.

* cited by examiner

*Primary Examiner* — Todd M Epps
(74) *Attorney, Agent, or Firm* — Argus Intellectual Enterprise, LLC; Jordan Sworen; Daniel Enea

(57) ABSTRACT

An interchangeable underlayer for a roofing device is provided. The interchangeable underlayer includes a base having a roof engaging first side and a roofing device engaging second side. The first side includes a plurality of protrusions and channels that engage with a surface of a roof. The second side includes a set of protrusions that secure to the roofing device, such as a roofing step that provides a non-sloped surface while working on a roof. In some embodiments, the roofing device includes a top side, a bottom side, and a pair of lateral sidewalls therebetween, wherein the bottom side can receive the set of protrusions of the second side of the base, forming the underlayer of the roofing device. The base is interchangeable with a second base having a differently configured first side to allow the roofing device to be used on a variety of different types of roofs.

17 Claims, 5 Drawing Sheets

INTERCHANGEABLE UNDERLAYER FOR A ROOFING DEVICE

BACKGROUND OF THE INVENTION

The present invention relates to roofing devices. More specifically, the present invention provides an interchangeable underlayer for a roofing step that can be replaced to allow the roofing device to be used on a variety of different types of roofs.

Roofing is a crucial aspect of building construction and maintenance, requiring workers to access different areas of the roof for inspection, repair, and installation. Traditional roof access methods often involve the use of ladders, scaffolding, or makeshift platforms. These methods, while functional to an extent, present several limitations and challenges.

Traversing pitched roofs is dangerous and requires safety precautions to be used. Some roofing devices, such as ladders, mats, and harnesses, assist with safety, but having issues with usability. In particular with multi-pitch roofs or use with different roof materials. Ladders, for instance, are commonly used for roof access but can be unstable, require careful placement, and might not provide sufficient surface area for workers to comfortably maneuver. Scaffolding, while more stable, is time-consuming to set up and may not be practical for smaller roofing tasks. Both of these methods are also largely dependent on the type of roof and its surface characteristics, limiting their versatility.

Other devices exist that can be placed directly on a roof. However, these devises lack versatility to be safely used on a variety of different types of roofing materials. Furthermore, these devices do not have an interchangeable base that allows the same roofing device to be easily used on any roof and transported between job sites. There exist some roof steps but they fail to have a system that adequately engages various roof materials. Therefore, there exists a need for an interchangeable base system that is compatible with a wide range of roof types and surfaces, including flat, sloped, tiled, asphalt and metal roofs. This eliminates the need for multiple access systems and streamlines the roofing process.

In light of the devices disclosed in the known art, it is submitted that the present invention substantially diverges in design elements and methods from the known art and consequently it is clear that there is a need in the art for an improvement for an interchangeable underlayer for a roofing device. In this regard the instant invention substantially fulfills these needs.

SUMMARY OF THE INVENTION

In view of the foregoing disadvantages inherent in the known types of interchangeable underlayers for roofing devices now present in the known art. The present invention provides a new interchangeable underlayer for a roofing device wherein the same can be utilized for allowing the roofing device to be used on a variety of different types of roofs.

It is an objective of the present invention to provide an interchangeable underlayer for a roofing device comprising a base having a roof engaging first side and a roofing device engaging second side, wherein the first side includes a plurality of channels and protrusions that engage with a surface of a roof. The second side of the base includes a set of protrusions disposed around a perimeter of the base configured to secure to the roofing device.

It is an objective of the present invention to provide an interchangeable underlayer for a roofing device comprising the roofing device having a top side, a bottom side, and a pair of lateral sidewalls therebetween, wherein the bottom side can receive the set of protrusions of the second side of the base, forming the underlayer of the roofing device.

It is an objective of the present invention to provide an interchangeable underlayer for a roofing device where the base is interchangeable with a second base having a differently configured first side to allow the roofing device to be used on a variety of different types of roofs.

It is therefore an object of the present invention to provide a new and improved interchangeable underlayer for a roofing device, that has all of the advantages of the known art and none of the disadvantages.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
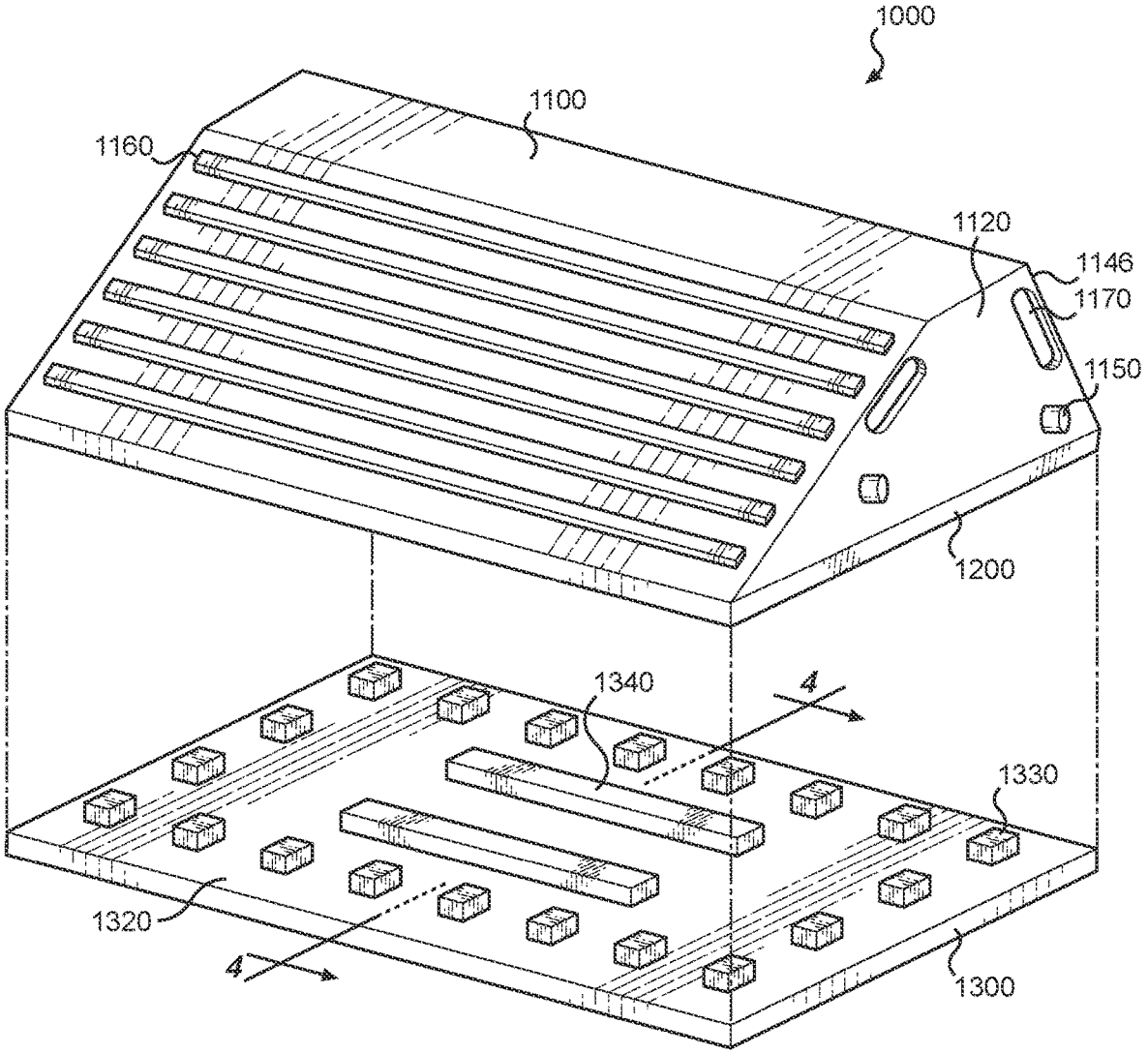
FIG. 1 shows an exploded view of an embodiment of an interchangeable underlayer and a roofing device.

Reference is made herein to the attached drawings. Like reference numerals are used throughout the drawings to depict like or similar elements of the interchangeable underlayer for a roofing device. For the purpose of presenting a brief and clear description of the present invention, the embodiment discussed will be used for securing and interchanging a base on a roofing device. The figures are intended for representative purposes only and should not be considered to be limiting in any respect. Furthermore, the described features, structures, or characteristics may be combined in any suitable manner in one or more embodiments. In the following description, numerous specific details are provided to give a thorough understanding of embodiments.

Reference will now be made in detail to the exemplary embodiment(s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment" does not necessarily refer to the same embodiment.

Figure 2:
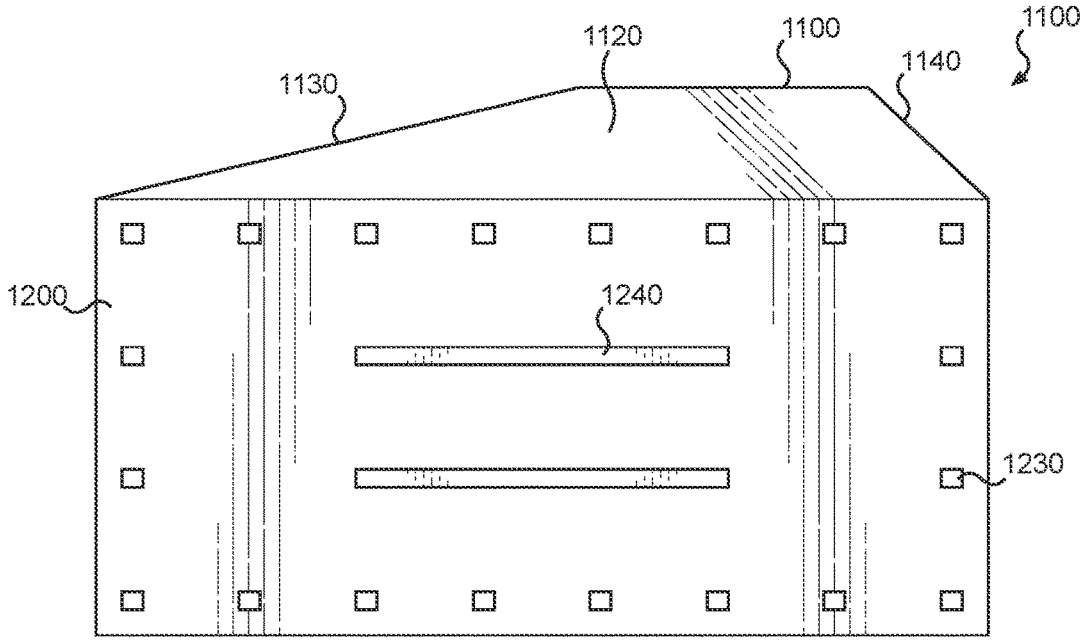
FIG. 2 shows a bottom perspective view of an embodiment of the roofing device.

Referring now to FIGS. 1 and 2, there is shown an exploded view of an embodiment of an interchangeable underlayer and a roofing device and a bottom perspective view of an embodiment of the roofing device, respectively. In the illustrated embodiment, the interchangeable underlayer 1000 for a roofing device 1100 comprises a base 1300 having a roof engaging a first side and a second side 1320 configured to removably secure to the roofing device 1100. In some embodiments, the interchangeable underlayer 1000 comprises the roofing device 1100, whereas in other embodiments, the roofing device is not included. In the illustrated embodiment, the roofing device 1100 comprises a top side 1110, a bottom side 1200, a front side 1130, a rear side 1140 and a pair of lateral sidewalls 1120 therebetween. The bottom side 1200 is configured to receive the base 1300, forming the underlayer of the roofing device.

In some embodiments, the roofing device 1100 is a step structure that rests on a pitched roof. The roofing device 1100 is configured to provide a horizontal, or near horizontal footrest area that allows a user to place their feet on while working on a roof. In the illustrated embodiment, the front side 1130 and rear sides 1140 of the roofing device 1100 are configured to be stepped on and used as a support when the roofing device is placed on a sloped surface. The roofing device 1100 tapers from the bottom side 1200 to the top side 1110 such that the bottom side 1200 surface area is greater than the top side 1110 surface area. In some embodiments, the slope of the front side 1130, measured by the interior angle formed between the bottom side 1200 and the front side 1130, is less than the slope of the rear side 1140, measured by the interior angle formed between the bottom side 1200 and the rear side 1140. In this way, the front or rear side can be used to achieve as close to a 180-degree surface as possible depending on the slope of the surface on which it is placed. In other embodiments, the slope of the rear side and the front side are equivalent.

In the illustrated embodiment, the front side, the rear side, or both, comprise a friction member configured to provide additional friction to a user standing thereon. In the illustrated embodiment, the friction member is a plurality of ridges 1160 extending between the sidewalls 1120 of the roofing device 1100. In alternate embodiments, the friction member comprises any suitable abrasive layer configured to prevent a user from slipping while standing thereon.

The bottom side 1200 of the roofing device 1100 comprises a fastener configured to secure to a mating fastener disposed on the second side 1320 of the base 1300. In the illustrated embodiment, the fastener comprises a first set of recesses 1230 configured to receive a first set of protrusions 1330. The set of recesses and protrusions are aligned with one another and disposed around a perimeter of the roofing device 1100 and base 1300, respectively. In the illustrated embodiment, a recess and protrusion each comprises a square cross section shape and have a substantially similar dimensions so as to friction fit with one another. In alternate embodiments, each protrusion comprises a flange at an upper end that once inserted within the recess, it is difficult to separate the protrusion from the recess without a lot of force or a tool.

In the illustrated embodiment, the fastener and mating fastener further comprise a second set of recesses 1240 and a second set of protrusions 1340, respectively. The second set of recesses and protrusions are elongated and disposed centrally on roofing de vice 1100 and base 1300, respectively. This fastener and mating fastener serve to provide additional securement between the roofing device and base. In some embodiments, the base and roofing device only comprise either the first set of recesses and protrusions or the second set of recesses and protrusions. In some embodiments, the second set of recesses and protrusions comprises a single recess and a single protrusion.

In the illustrated embodiment, the roofing device 1100 comprises a pair of handle insets 1170 disposed within each lateral sidewall 1120. In some embodiments, a handle extends outward form one or both lateral sidewalls. In other embodiments, the roofing device does not include a handle.

Figure 3:
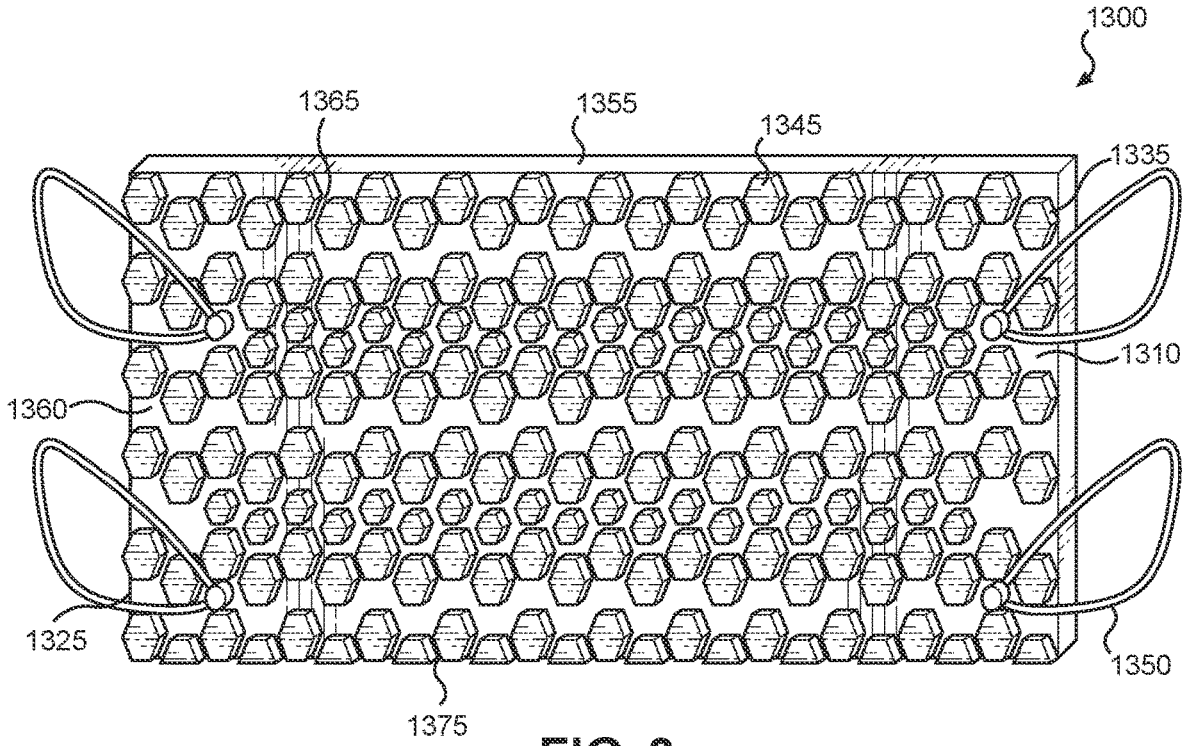
FIG. 3 shows a bottom perspective view of a first base of an embodiment of an interchangeable underlayer.
Figure 4:
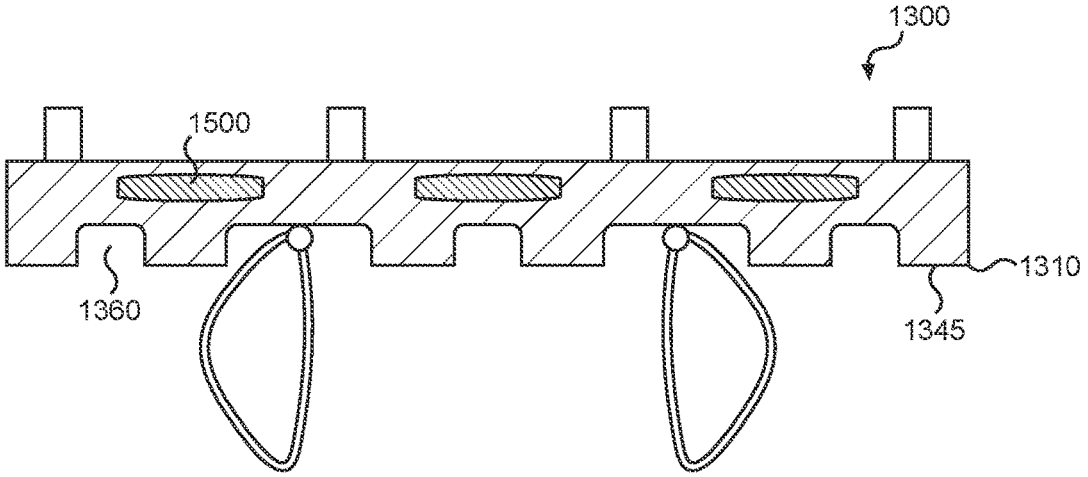
FIG. 4 shows a cross-sectional view of a first base taken along line 4-4 of FIG. 1 of an embodiment of an interchangeable underlayer.

Referring now to FIGS. 3 and 4, there is shown a bottom perspective view of a base of an embodiment of an interchangeable underlayer for a roofing device and a cross-sectional view of a base of an embodiment of an interchangeable underlayer for a roofing device, respectively. In the illustrated embodiment, the first side 1310 of the base 1300 comprises a plurality of projections 1345 extending therefrom. The projections 1345 are configured to engage with a roof and prevent slippage of the roofing device. In the illustrated embodiment, a set of projections are disposed in a row 1335 extending from a pair of lateral sidewalls 1325 of the base 1300. Between each row 1335 is a channel 1360 configured to engage with a ridge or protrusion on a roof. In some embodiments, the channels 1360 and the rows 1335 of projections 1345 extend between a front side 1355 and a rear side 1375 of the base 1300 to allow the channels 1360 to engage with protrusions or ridges of a roof running between a bottom of the roof to the apex of the roof. In the illustrated embodiment, each projection 1345 comprises a hexagonal cross-sectional shape to allow a staggered pattern of projections within a row to allow for maximum roof surface engagement while forming gaps 1365 between each projection to allow liquid to flow past each projection. The gaps 1365 prevent water from pooling within a channel 1360.

In the illustrated embodiment, the base 1300 comprises a plurality of tie downs 1350 each extending through a channel 1360 on the first side 1310 thereof. The tie downs 1350 are configured to secure to a receiving member disposed on the roofing device. In the illustrated embodiment, the tie downs are elastic and form a loop. In the embodiment shown in FIG. 1, the receiving member is a knob 1150 that receives the tie down 1350 therearound. A pair of knobs 1150 are disposed on each sidewall 1120 of the roofing device 1100. In the shown embodiment, the knobs extend below the handle insets and align with a channel 1360 such that the tie down extends horizontally within the channel and vertically upwards along the sidewall 1120. In some embodiments, have a cutout disposed on an upper end forming a notch for preventing the tie down wrapped therearound from slipping.

In some embodiments, such as shown in FIG. 4, the base 1300 comprises a magnetic fastener 1500 to allow the base 1300 to magnetically secure to a metal roof. In some embodiments, the magnetic fastener 1500 is disposed within a channel 1360 or on a projection 1345 on the first side 1310 of the base 1300. In the illustrated embodiment, the magnetic fastener 1500 is embedded or inserted within the base 1300. Other embodiments, the base does not include a magnetic fastener.

Figure 5:
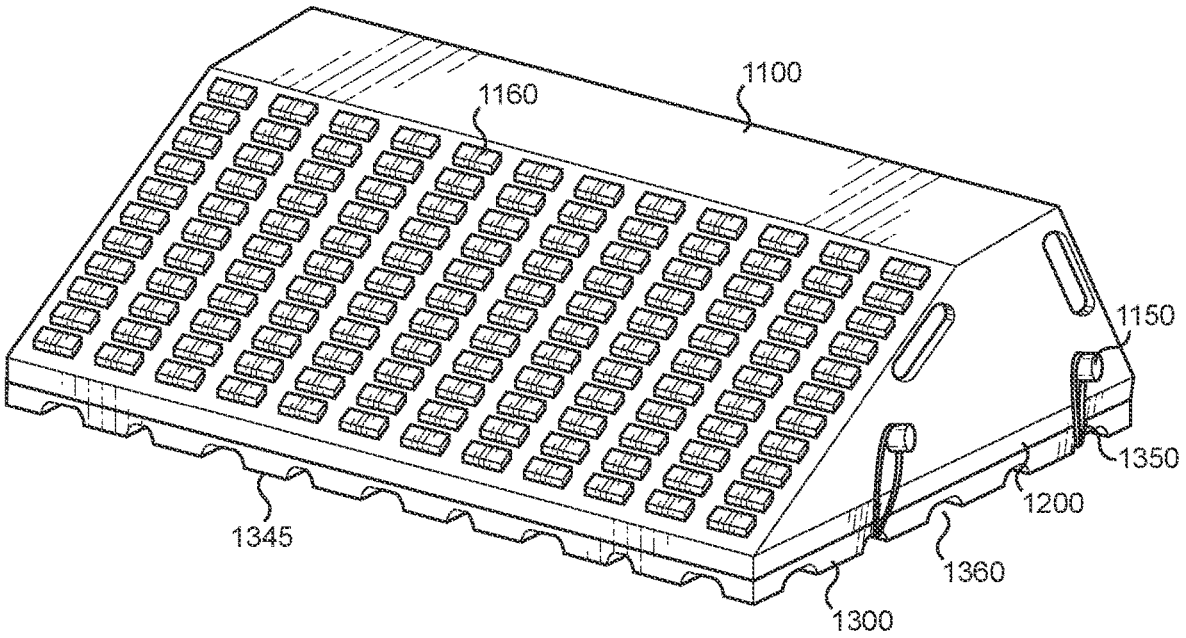
FIG. 5 shows a perspective view of an embodiment of an interchangeable underlayer coupled to the roofing device.
Figure 6:
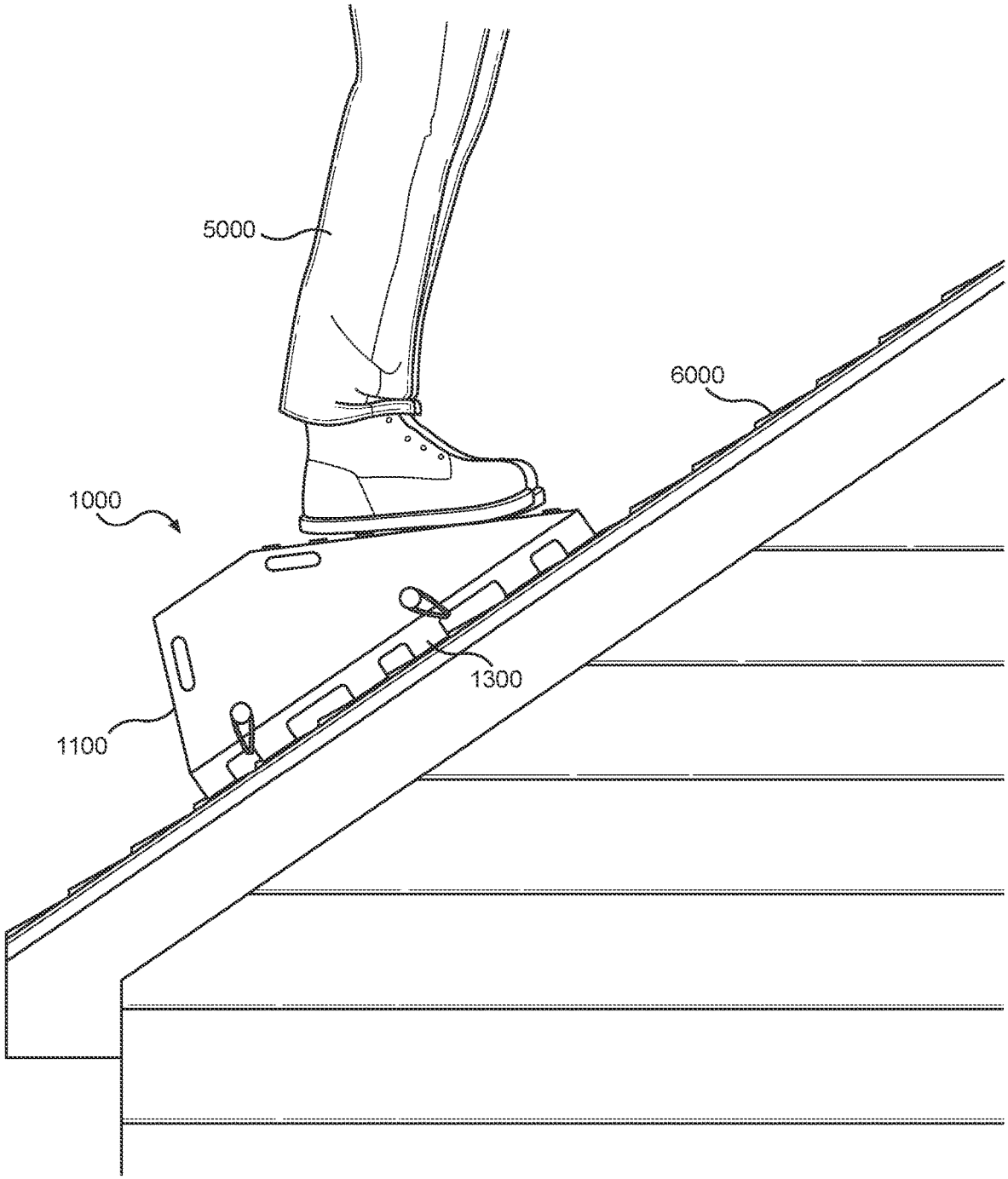
FIG. 6 shows a perspective view of an embodiment of an interchangeable underlayer coupled to the roofing device in use.

Referring now to FIGS. 5 and 6, there is shown a perspective view of an embodiment of an interchangeable underlayer coupled to the roofing device and an embodiment of an interchangeable underlayer coupled to the roofing device in use, respectively. In operation, the base 1300 is secured to the bottom side 1200 of the roofing device 1100 via the mating recesses and protrusions. The tie downs 1350 are pulled through a channel 1360 in which they extend from and fastened around the aligned knob 1150. The roofing device can be manipulated and moved via grasping the handle insets disposed on either sidewall 1120 thereof. A user places the roofing device 1100 with attached base 1300 on a sloped roofing surface. The user is able to stand either on the front side or rear side of the roofing device 1100, depending on the degree of the slope of the roof. The ridges 1160 prevent a user's feet from slipping while the projection 1345 and channel 1360 arrangement are configured to prevent movement of the roofing device beneath the user's feet.

Figure 7:
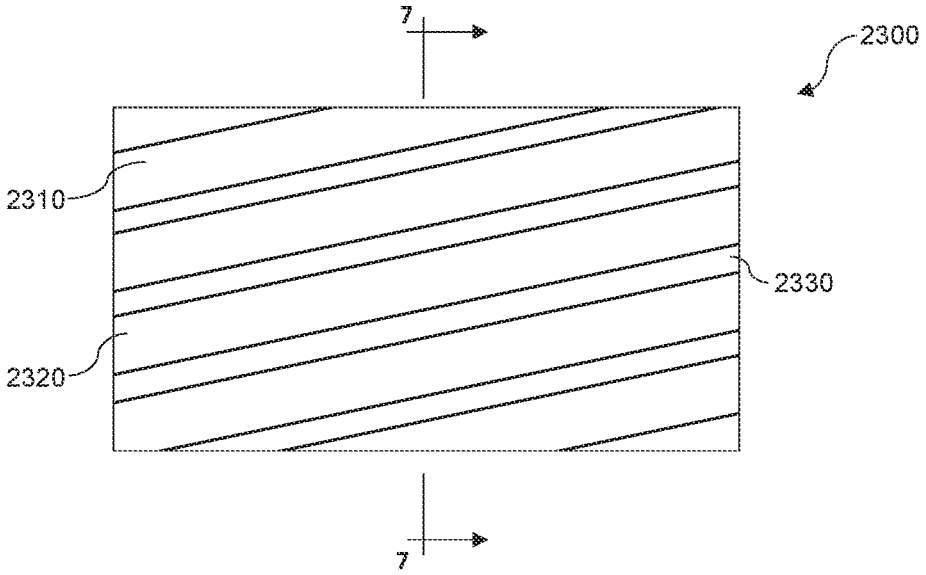
FIG. 7 shows a bottom planar view of a second base of an embodiment of an interchangeable underlayer.
Figure 8:
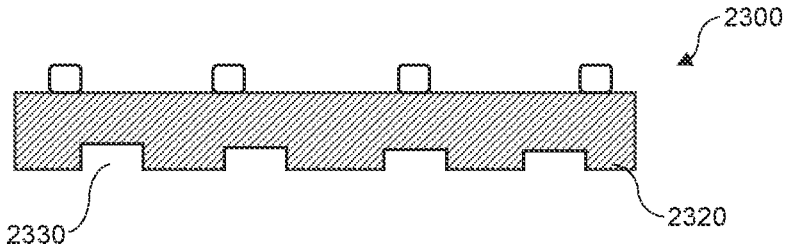
FIG. 8 shows a cross-sectional view of a second base taken along line 7-7 of FIG. 6 of an embodiment of an interchangeable underlayer.

Referring now to FIGS. 7 and 8, there is shown a bottom planar view and a cross-sectional view of a second base of an embodiment of an interchangeable underlayer, respectively. In some embodiments, the interchangeable underlayer for a roofing device comprises a second base 2300 comprising a different bottom side 2310, wherein the configuration of the projections and channels is different from the first base, or wherein the projections comprise a different shape better suited to the configuration of the roof to which it will be placed upon. For example, in the illustrated embodiment, the second base 2300 comprises a series of projections 2320 and channels 2330 configured to correspond to a roofing panel having a series of equally spaced ribs configured to fit within each channel 2330. In the shown embodiment, the projections are disposed diagonally or offset from a horizontal or longitudinal axis of the second base 2300. In this way the roofing step is configured to abut a roofing surface, wherein a top side thereof remains substantially horizontal when the roof comprises panels that are offset or disposed at a particular angle. In alternate embodiments, the projections and channels are aligned with the longitudinal or horizontal axis of the base.

In some embodiments, the second base comprises a foam material. In other embodiments, the second base is a duplicate of the first base. This allows a user to easily replace the base 1300 if it becomes damaged or worn. In the illustrated embodiments, the base is composed of an injection moldable material, such as rubber, elastomer, thermoplastic polyurethane, thermoplastic rubber, and the like.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An interchangeable underlayer for a roofing device, comprising:

a base having a first side and a second side, wherein the second side is configured to removably secure to the roofing device and the first side is configured to be placed directly on a roof;

wherein the first side comprises a plurality of projections and a channel formed between the plurality of projections;

wherein the second side comprises a first fastener configured to secure the base to a first mating fastener of the roofing device;

wherein the base is interchangeable with a second base, wherein the second base comprises a first side having a different configuration of projections.

2. The interchangeable underlayer of claim 1, wherein the first fastener comprises a first set of protrusions and a second protrusion, wherein the first set of protrusions are disposed around a perimeter of the second side of the base and the second protrusion is elongated and centrally disposed on the second side of the base.

3. The interchangeable underlayer of claim 1, wherein the second base comprises a foam material having a second side with a second fastener having a same configuration as the base and configured to secure the second base to the first mating fastener of the roofing device.

4. The interchangeable underlayer of claim 1, further comprising a tie down extending from the channel, wherein the tie down is configured to secure to the roofing device.

5. The interchangeable underlayer of claim 1, further comprising the roofing device having a top side, a bottom side, and a pair of lateral sidewalls therebetween, wherein the bottom side is configured to receive the fastener of the second side of the base, forming the underlayer of the roofing device.

6. The interchangeable underlayer of claim 5, wherein the fastener comprises a first set of protrusions disposed around a perimeter of the first side of the underlayer.

7. The interchangeable underlayer of claim 6, wherein the bottom side of the roofing device comprises a mating fastener having a first set of recesses configured to align with and receive the first set of protrusions.

8. The interchangeable underlayer of claim 5, wherein the first fastener further comprises a second protrusion that is elongated and centrally disposed on the first side of the base.

9. The interchangeable underlayer of claim 8, wherein the bottom side of the roofing device comprises a second recess configured to align with and receive the second protrusion.

10. The interchangeable underlayer of claim 5, further comprising a tie down extending through the channel, wherein the tie down is configured to secure to the roofing device.

11. The interchangeable underlayer of claim 10, wherein the roofing device comprises a receiving member disposed on each lateral sidewall for receiving the tie down therearound.

12. The interchangeable underlayer of claim 11, wherein the receiving member is a knob.

13. The interchangeable underlayer of claim 5, wherein the roofing device comprises a handle inset within each lateral sidewall.

14. The interchangeable underlayer of claim 5, wherein the roofing device comprises a handle extending outward from a lateral sidewall of the pair of lateral sidewalls.

15. The interchangeable underlayer of claim 5, wherein the roofing device comprises a front side and a rear side extending between the pair of lateral sidewalls, wherein the front side comprises a plurality of ridges.

16. The interchangeable underlayer of claim 1, further comprising a magnetic fastener secured to the base.

17. The interchangeable underlayer of claim 1, wherein the base is injection molded.

* * * * *